United States Patent [19]

Koontz

[11] 4,210,353

[45] Jul. 1, 1980

[54] TOOL FOR INSERTING COMBINATION INSULATION STOP AND VENTILATION BAFFLE ARTICLES IN ROOF STRUCTURES

[76] Inventor: Bryce L. Koontz, 11432 - 41st NE., Marysville, Wash. 98270

[21] Appl. No.: 946,711

[22] Filed: Sep. 28, 1978

[51] Int. Cl.[2] ..... A47F 13/06

[52] U.S. Cl. ..... 294/19 R

[58] Field of Search ..... 294/19 R, 27, 23, 21, 294/20, 10, 14, 1 R, 55.5, 61, 86 R; 81/3 R; 210/238, 541, 542; 254/131

[56] References Cited

U.S. PATENT DOCUMENTS

| | | | |
|---|---|---|---|
| 1,468,878 | 9/1923 | Donald | 294/22 |
| 3,727,963 | 4/1973 | Dranoff | 294/19 R |

FOREIGN PATENT DOCUMENTS

| | | | |
|---|---|---|---|
| 771120 | 10/1934 | France | 294/19 R |

*Primary Examiner*—James B. Marbert

*Attorney, Agent, or Firm*—Wells, St. John & Roberts

[57] ABSTRACT

A tool is described that enables insertion and handling of combination insulation stop and ventilation baffle articles into roof structures from a remote location within the structures. The tool includes an elongated tube that has a pair of pincers at a forward end and an actuator at a rearward end. A link mechanism interconnects the pincers and actuator to enable manual manipulation of the actuator to move the pincers between closed and open positions. Forward ends of the pincers are pointed to facilitate penetration through baffle articles. Transverse projections are provided along the pincers rearward of the forward points which project toward one another. These projections also include pointed ends and are utilized for engaging and penetrating the baffle articles.

7 Claims, 5 Drawing Figures

TOOL FOR INSERTING COMBINATION INSULATION STOP AND VENTILATION BAFFLE ARTICLES IN ROOF STRUCTURES

BACKGROUND OF THE INVENTION

Increased usage of spray forms of building insulation has led to the development and widespread use of combination insulation stop and ventilation baffle articles such as that disclosed in my prior U.S. Pat. No. 3,863,553 granted Feb. 4, 1975. Such baffles are utilized to assist in the installation of loose fiber or particulate thermal insulation to the crawl space or attic between the ceiling and roof of a building structure. This is done to avoid water damage that is often attributed to inadequate installation of thermal insulation which obstructs ventilation space immediately below the roof and above the ceiling. The baffle articles also enable placement of the loose fill or particulate insulation over the exterior plate of the wall, an area which is very difficult to properly insulate without obstructing air flow through soffit ventilators.

A problem existing with the current forms of combined insulation stop and ventilation baffles is in the handling and placement of the baffles between roof rafters. The roof is typically at a pitch relative to the ceiling that severely restricts access to the wall plate where the baffle is to be installed. Of course, with low pitch roofs, access is nearly impossible.

The problem of holding the baffle articles in place between the roof rafters is solved by the baffle that is the subject of my current application, Ser. No. 910,602 filed on May 30, 1978. It discloses a baffle article with a flexible rod of a length somewhat greater than the distance between adjacent roof rafters. The article can be inserted between rafters with the ends of the rod engaging the rafters and causing the rod to bend along its length. Spring action of the rod operates against the adjacent rafters to hold the baffle article in place relative to the plate. While this form of baffle article is quickly and easily placed, the installer must gain access to the area above the wall plate before the article can be installed. Therefore, the access problem remains and it becomes very desirable to obtain some form of tool for handling and placing baffle articles such as those described above between roof rafters of building structures.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
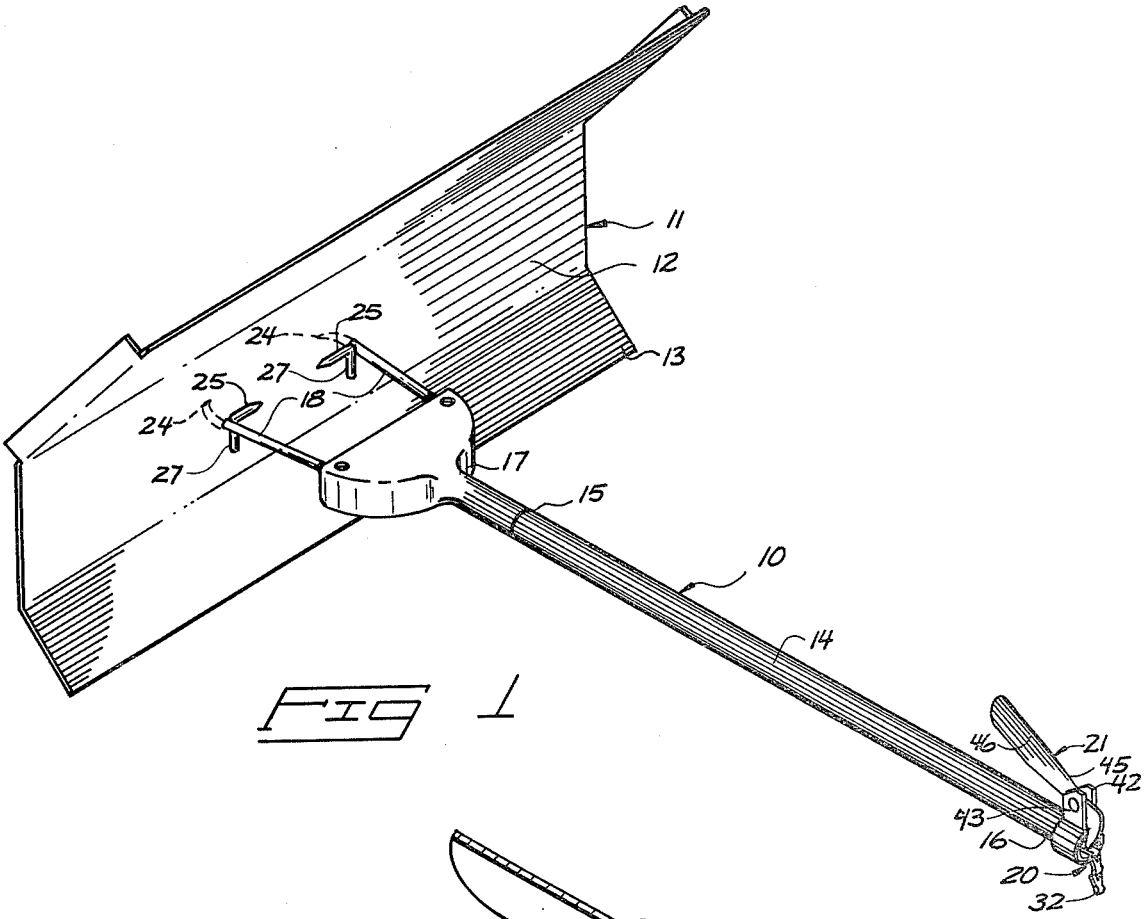
FIG. 1 is an isometric view of the present tool having engaged and penetrated a baffle article.

A tool embodying a preferred form of the present invention is illustrated in the accompanying drawings and is designated therein by the reference character 10.

The present tool 10 is utilized for the specific purpose of handling and installing combination insulation stop and ventilation baffle articles (heretofore termed "baffle article") between the roof rafters and above exterior wall plates of building structures. An example of a baffle article is illustrated in FIG. 1 at 11. It typically includes at least one planar surface 12 and is constructed of a relatively thin bendable material such as corrugated paper or "cardboard", although the tool may be equally as effectively utilized on baffle articles constructed of other material. The tool 10 is elongated and manually operable from one end thereof to enable handling and insertion of the baffle article 11 into very restricted areas of building structures with the flap 13 engaging the top of the exterior wall plate and with the sides of the baffle article engaging the roof rafters.

The present tool 10 includes an elongated rigid tube 14 extending from a forward end 15 to a rearward end 16. The tube 14 is hollow along its length and is preferably constructed of a lightweight rigid metal such as aluminum or other lightweight alloy. A housing 17 is mounted at the forward tube end 15. It mounts a pair of pincers 18. Preferably both but at least one of the pincers is pivoted to the housing at a pivot 19. A link means 20 extends from the pincers rearwardly to a pincer actuator 21 located at the rearward tube end 16. Manual manipulation of the actuator 21 causes relative movement of the pincers 18 between a gripping position shown in FIG. 5 and a release position shown in FIG. 4.

The housing 17 includes a forwardly open recess 22 (FIGS. 4 and 5) for receiving and pivotally mounting the pincers 18 about parallel transverse axes (relative to the tube axis). It also includes a bore **22*a* through which the link means extends to connect with the pincers. A tubular female 23 (FIG. 4) is provided at a rearward end of the housing 17 to facilitate removable mounting of the housing to the forward end 15 of tube 14**.

Figure 5:
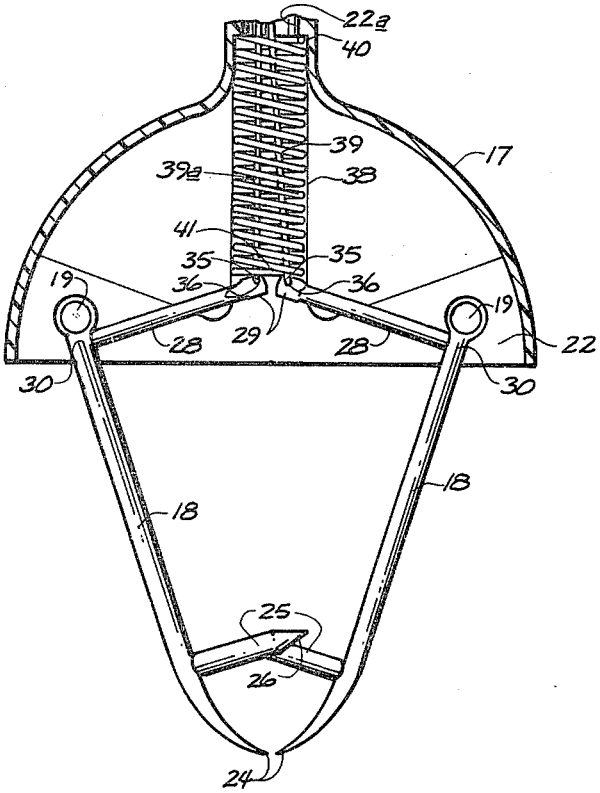
FIG. 5 is a view similar to FIG. 4 only showing a different operational position of the elements therein.
Figure 4:
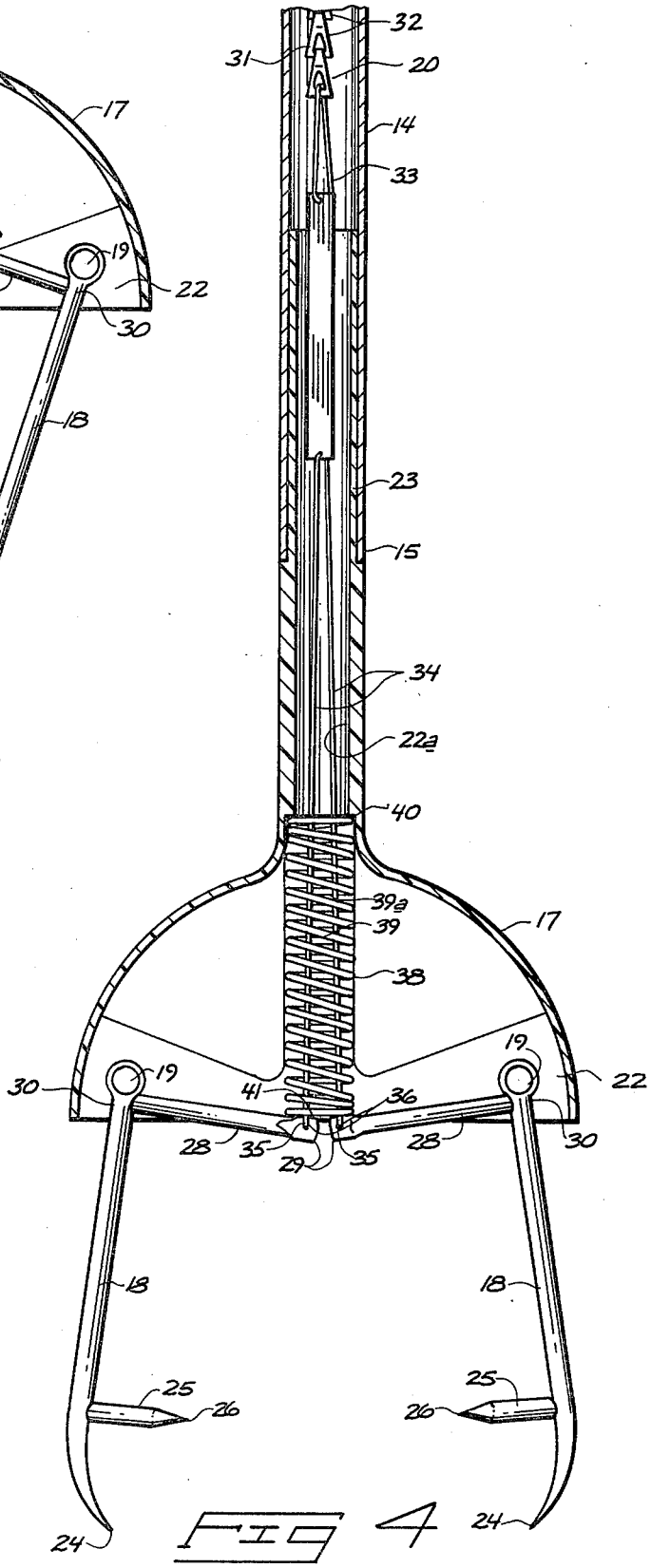
FIG. 4 is an enlarged fragmentary section taken through a forward end of the present tool.

The pincers 18 each include a pointed forward end 24. The pointed ends 24 are curved toward each other as shown in FIGS. 1, 4 and 5. This facilitates engagement and penetration through the surface 12 of a baffle article while also enabling relatively easy disengagement and withdrawal of the points from the article as the actuator 21 is manipulated.

Transverse projections 25 are provided rearward of the pointed ends 24. They also include pointed ends 26. These pointed ends 26 face toward one another. The projections 25 and pointed ends 26 also facilitate handling of a baffle article 11 therebetween.

Adjacent the pointed ends 26 are penetration stops 27 (FIG. 1). Stops 27 project at right angles to the transverse projections 25 and are situated at a prescribed distance from the pointed ends 24 to prevent penetration of the pincers beyond a prescribed depth into the baffle article. This is illustrated in FIG. 1 where the pointed ends 24 are shown projecting through the baffle article with stops 27 in abutment with the surface 12. It is also contemplated that the stops 27 may also be utilized for gripping and handling a baffle article, especially for handling the article once it has been placed over an exterior wall plate and it becomes desirable to maneuver the article into proper position. Unlike the projections 25, the stops 27 can be hooked over an edge of a baffle to push or pull it into position.

A pair of crank arms 28 extend transversely outward from rearward ends 30 of the pincers 18 adjacent the pivots 19. The crank arms 28 are transverse relative to the length of the pincers and to the tube 14. They extend to outward ends 29 that are situated adjacent one another and are in substantial alignment with the bore of the tube 14. The outward ends 29 of crank arms 28 are connected with the link means 20.

Link means 20 is basically comprised of an elongated chain 31 formed of a plurality of interconnected chain links 32. A link connector 33 is removably provided at a forward end of chain 31 and includes a forwardly projecting bifurcation 34. The bifurcation includes hooks 35 at opposite ends thereof that extend through apertures 36 in the outward ends of crank arms 28. Therefore, longitudinal movement of the chain within the tube 14 may result in corresponding pivotal movement of the pincers about the pivots 19.

A biasing means 38 (FIGS. 4 and 5) is provided in the form of a spring 39 to continuously urge the pincers to the open position of FIG. 4. The spring 39 includes an end 40 that is held against the housing 17 and a remaining end 41 that is urged against the outward ends 29 of the crank arms 28. The spring is coaxial with the tube 14 and receives the bifurcation 34 through a central longitudinal opening 39*a*. The spring is therefore held in place by the bifurcation and by the engagement of its ends with the housing and crank arms.

Figure 2:
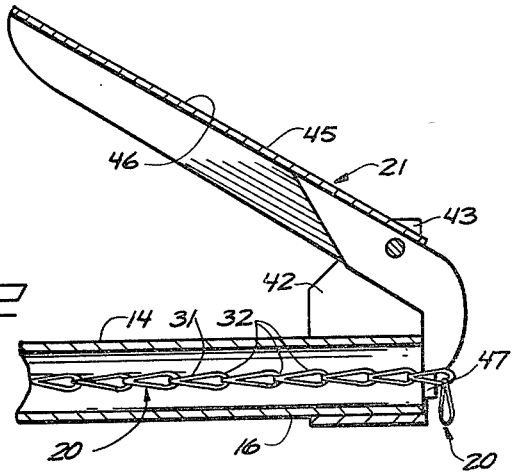
FIG. 2 is an enlarged sectional fragmentary view of the actuating mechanism of my invention.
Figure 3:
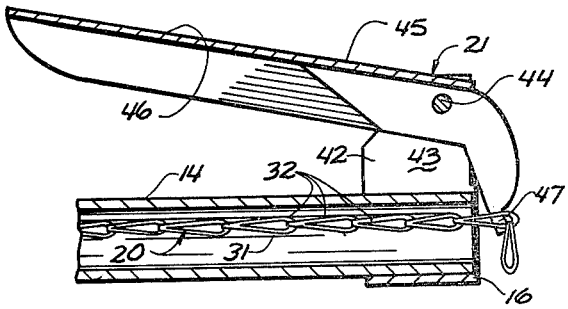
FIG. 3 is a view similar to FIG. 2 only showing a different operational position of the actuating mechanism.

The pincer actuator 21 is illustrated in some detail in FIGS. 1 through 3. It is mounted to the tube 14 by a bracket 42. The bracket 42 has upstanding ears 43 to receive a pivot pin 44. A handle 45 is pivotably mounted to the bracket by the pin 44. Handle 45 includes a hand grip 46 the extends forwardly from the pin 44 over the tube 14. A link engaging member 47 extends rearwardly opposite to the handle from the pin 44. It is situated to be selectively engaged through an appropriate link of the chain 31. The link is removably received by the chain so that the chain and housing 17 may be removed and attached to a tube and actuator of different length.

The chain is connected to the link engaging member 47 simply by pulling the chain taut and inserting an adjacent link opening over the link engaging member 47. Then, when it is desired to close the pincers to the FIG. 5 position, the installer simply grips the tool with the tube and handle in one hand, urging the handle grip 46 toward the tube 14. This pivots the link engaging member rearwardly and tightens the chain 31. Rearward movement of the chain through the length of the tube to the connections at the crank arms 28 causes corresponding pivotal movement of the pincers toward one another. This movement is made against the yieldable resistance of the spring 39 which, when the handle is released, will return the pincers to the open position.

From the above description, operation of the present invention may now be easily understood. The installer may position himself within a building structure in the attic at a central location where he has freedom of movement. He may then attach a baffle article to the pincers by inserting the pointed ends 24 through the article material until the article rests against the projections 25 and stop 27. The article is securely gripped as the pincers 18 are urged toward the closed position of FIG. 5. This is done manually by urging the hand grip 46 toward the tube 14. This manual manipulation is accomplished at the rearward end of the tube to enable maneuvering and insertion of the baffle at a location remote from the installer's station within the building structure with the projections 25 and stops bearing against the article. Once the baffle article has been positioned properly between adjacent roof rafters and over the wall plate, the installer may release the baffle from engagement by the tool simply by releasing his grip on the handle 45. The inwardly curved pointed ends 24 facilitate disengagement as the pincers move to the open position. Should it be necessary to remove and reposition a once installed article, the operator may grip an edge of the article between the point ends 26 and pull the article from its position and then mount the article on the pincer points 24 for reinstallation.

Of course, different building structures may include roof structures of different pitch and different spans. Therefore, it is intended that the tool be provided with a number of tubes 14 of varying lengths. The housing 17 may be easily removed from the tube and chain 31 disengaged from the tube and actuator 21 from the link engaging member 47 to facilitate removal of the tube and actuator 21 from the remainder of the tool. The housing may then be mounted at the forward end of a tube of different length and the chain connected to a link engaging member mounted to that tube.

It is to be noted that the above description is exemplary and is not intended to restrict the scope of my invention. Only the following claims are to be taken as definitions of my invention.

What I claim is:

1. A tool for remote installation of combination insulation stop and ventilation baffle articles in roof structures, comprising:

a hollow enlongated tube extending from an open forward end to an open rearward end;

a housing at the forward end of the tube;

a pair of pincers mounted to the housing and extending forwardly therefrom;

said pincers each having a pivoted end extending forward and curved inward toward each other for penetrating a baffle article from one side thereof to grip the article transversely across the forward end of the tool to enable the article to be installed in a remote location in the roof structure;

said pincers each having transversely extending penetration stops rearward of the pointed ends for engaging the transversely extending article and limiting penetration of the pointed ends through the one side of the article;

said pincers being pivotally mounted to the housing for movement toward each other to cause the curved pointed ends to penetrate the one side of the article until the article abuts the penetration stops and to grip the article between the pincers with the article extending transversely across the forward end of the tool and for movement away from each other to gradually pull the pointed ends from the one side of the article to release the article;

link means operatively connected to the pincers and extending to the rear end of the hollow tube;

spring means operatively connected to the pincers for biasing the pincers away from each other; and a manually operable pincer actuator at the rearward end operatively connected to the link means for moving the pincers toward each other against the bias of the spring means.

2. The tool as defined by claim 1 wherein the actuator is comprised of a handle pivotally mounted to the tube with a forwardly extending hand grip on one side of its pivot axis and a link engaging member on an opposite side of its pivot axis.

3. The tool as defined by claim 2 wherein the link means is comprised of a chain connected at one end to the one pincer and wherein the link engaging member is designed to releasably engage the chain between the links thereof.

4. The tool as defined by claim 3 wherein the housing is removably mounted to the tube and the link means is removably mounted to the actuator.

5. The tool as defined by claim 1 wherein the one pincer includes a crank arm extending from a rearward pincer end transversely toward the other pincer, and wherein the link means is connected to the crank arm at an outer end thereof.

6. The tool as defined by claim 1 wherein both pincer members are pivoted to the housing about parallel transverse axes and wherein each pincer includes a crank arm extending from a rearward end transversely toward the other pincer and wherein the link means includes a bifurcation connected to the crank arm at forward ends thereof.

7. The tool as defined by claim 6 further comprising a compression spring within the housing having one end engaging the housing and a remaining end engaging the outer ends of the crank arms to thereby urge the pincers away from each other and wherein the bifurcation extends through a central longitudinal opening of the spring.

* * * * *